US008842846B2

(12) United States Patent
Yonemoto et al.

(10) Patent No.: US 8,842,846 B2
(45) Date of Patent: Sep. 23, 2014

(54) METHOD AND APPARATUS FOR POLARITY DETECTION OF LOUDSPEAKER

(75) Inventors: Akihiro Yonemoto, Bunkyo-Ku (JP); Steven David Trautmann, Tsukuba (JP)

(73) Assignee: Texas Instruments Incorporated, Dallas, TX (US)

( * ) Notice: Subject to any disclaimer, the term of this patent is extended or adjusted under 35 U.S.C. 154(b) by 495 days.

(21) Appl. No.: 12/406,252

(22) Filed: Mar. 18, 2009

(65) Prior Publication Data

US 2010/0239099 A1 Sep. 23, 2010

(51) Int. Cl.
*H04R 29/00* (2006.01)
*H04S 7/00* (2006.01)

(52) U.S. Cl.
CPC ..... *H04S 7/00* (2013.01)
USPC ..... 381/59; 381/58; 381/96; 381/303

(58) Field of Classification Search
CPC ..... H04R 5/04; H04R 29/00; H04R 29/001; H04S 7/00; H04S 7/301; H04S 7/302
USPC ..... 381/58, 59, 96
See application file for complete search history.

(56) References Cited

U.S. PATENT DOCUMENTS

| | | | | |
|---|---|---|---|---|
| 5,966,689 | A * | 10/1999 | McCree | 704/226 |
| 2006/0050891 | A1 * | 3/2006 | Bharitkar | 381/59 |
| 2006/0062399 | A1 * | 3/2006 | McKee Cooper et al. | 381/58 |
| 2010/0119075 | A1 * | 5/2010 | Xiang et al. | 381/63 |

* cited by examiner

*Primary Examiner* — Minh-Loan T Tran
*Assistant Examiner* — Fazli Erdem
(74) *Attorney, Agent, or Firm* — Mima Abyad; Frederick J. Telecky, Jr.

(57) ABSTRACT

A method and apparatus for polarity detection. The method includes applying a band-pass filter to an impulse response of a loudspeaker, applying an exponential weighting to the band-pass filtered impulse response, wherein the exponential decay parameter is related to the higher corner frequency of the band-pass filter, finding the maximum peak in a waveform of sampled impulse responses, and detecting the connection polarity of the maximum peak as the polarity of the peak.

6 Claims, 8 Drawing Sheets

METHOD AND APPARATUS FOR POLARITY DETECTION OF LOUDSPEAKER

BACKGROUND OF THE INVENTION

1. Field of the Invention

Embodiments of the present invention generally relate to a method and apparatus for loudspeaker polarity detection. More specifically, a method and apparatus for multi-way loudspeaker polarity detection.

2. Background of the Invention

It has become popular for audio amplifiers to have an automatic loudspeaker configuration function as multi-channel audio systems became widespread. Polarity detection is one of the features commonly supported by such automatic loudspeaker systems, which include configuration functions to ensure that the loudspeakers are wired correctly in terms of the connection polarity. For example, the polarity detection ensures the proper connection of the positive/negative terminal of the loudspeaker and the positive/negative terminal of the audio amplifier.

However, the polarity detection is known to be susceptible to the microphone position and room reflections. In addition, the polarity detection tends to be more unstable for multi-way loudspeakers due to the spatial separation of speaker drivers.

Therefore, there is a need for an improved loudspeaker polarity detection method and apparatus.

SUMMARY OF THE INVENTION

Embodiments of the present invention relate to a method and apparatus for method and apparatus for polarity detection. The method includes applying a band-pass filter to an impulse response of a loudspeaker, applying an exponential weighting to the band-pass filtered impulse response, wherein the exponential decay parameter is related to the higher corner frequency of the band-pass filter, finding the maximum peak in a waveform of sampled impulse responses, and detecting the connection polarity of the maximum peak as the polarity of the peak.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. A computer readable medium is any medium that can be utilized by a computer to read, write or save data. Such a medium may be coupled to, external or internal to the computer.

DETAILED DESCRIPTION

Along with the home theater systems, multi-channel audio systems have become more popular in home audio applications, which have become widespread. It is common for such multi-channel audio systems to have the 5.1 ch configuration, i.e., five satellite speakers and one sub-woofer or even more such as the 7.1 ch systems. However, it can be a difficult task to set up a multi-channel environment appropriately. The users need to wire the loudspeakers to the audio amplifier with long cables and adjust channel delay and volume balance according to the placement of the loudspeakers. To help ease the setup, the latest audio amplifiers are usually equipped with means to measure the loudspeaker distance, loudness, and frequency characteristics. In addition, such amplifiers are capable of automatically configuring the loudspeaker delay, volume, and equalize the frequency characteristics.

Figure 1:
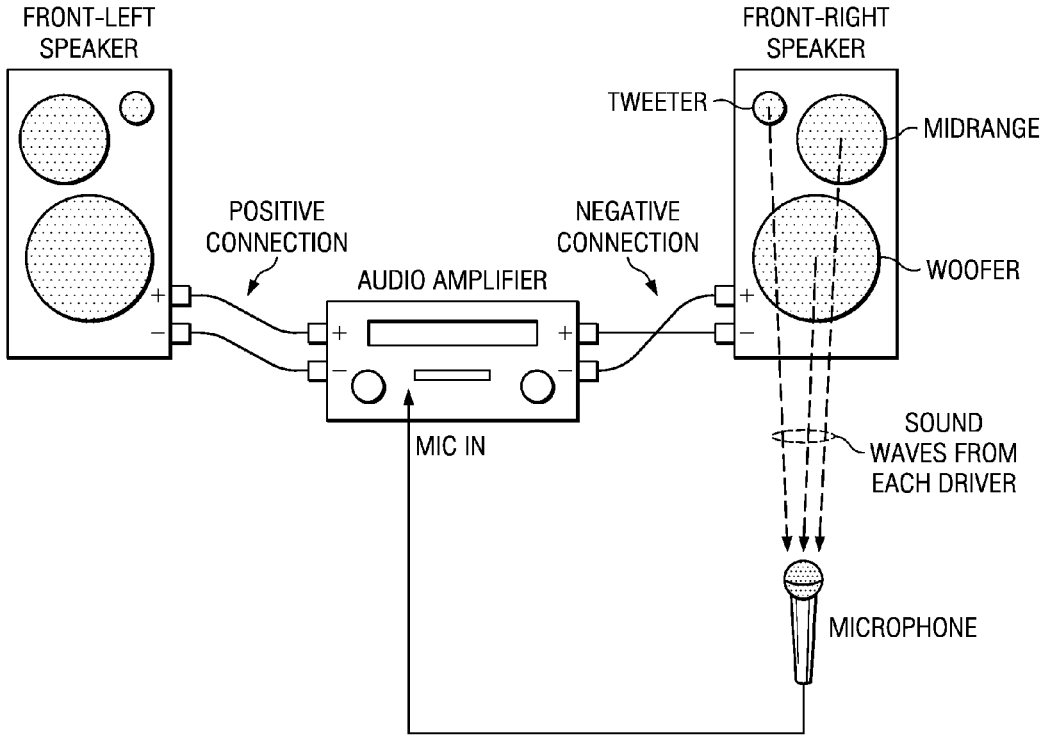
FIG. 1 is an embodiment of a polarity detection of multi-way loudspeaker connection by audio amplifiers.

FIG. 1 is an embodiment of a polarity detection of multi-way loudspeaker connection by audio amplifier. As shown in FIG. 1, the audio amplifier outputs test signals from the loudspeakers, and records the reproduced sound with the microphone placed at the listening position. The recorded signals are used to analyze the loudspeaker configuration and set the adjustment parameters. As for the test signal, signals that cover the wide range of frequencies, such as, white noise, pink noise, and swept sinusoid, are used. The recorded signals are de-convolved with the test signal to obtain the loudspeakers' impulse response.

In such automatic loudspeaker setup applications, the polarity of the loudspeaker connection is generally checked first once the loudspeaker's presence is detected. Namely, it is checked if users correctly wire the positive terminals and negative terminals of the loudspeaker and the audio amplifier. If the negative (i.e. wrong) connection is detected as in the case of the front right channel in FIG. 1, the audio amplifier would prompt the users to check the wiring. The connection polarity may be detected from the impulse response of the loudspeakers.

Figure 2:
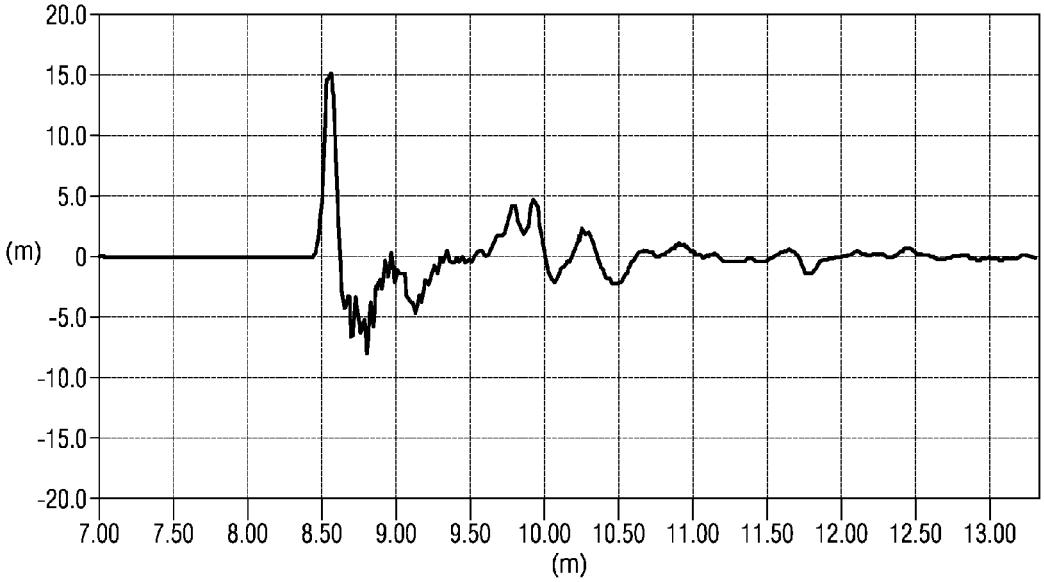
FIG. 2 is an embodiment of an impulse response of a single-way loudspeaker.

FIG. 2 is an embodiment of an impulse response of a single-way loudspeaker. In FIG. 2, since a large impulse on the positive side is shown, then one deduces that FIG. 2 shows a positive polarity. Thus, it can be said that this loudspeaker is connected correctly in the positive direction. However, the polarity is sometimes very ambiguous especially when the multi-way loudspeakers are used.

Figure 3A:
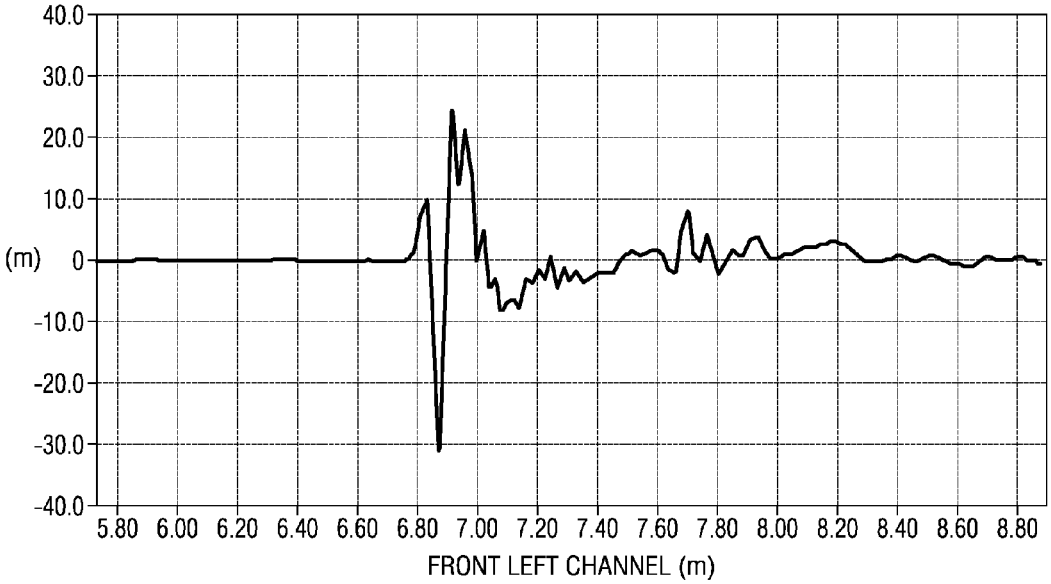
FIG. 3 is an embodiment of an impulse response of the same two three-way loudspeakers.
Figure 3B:
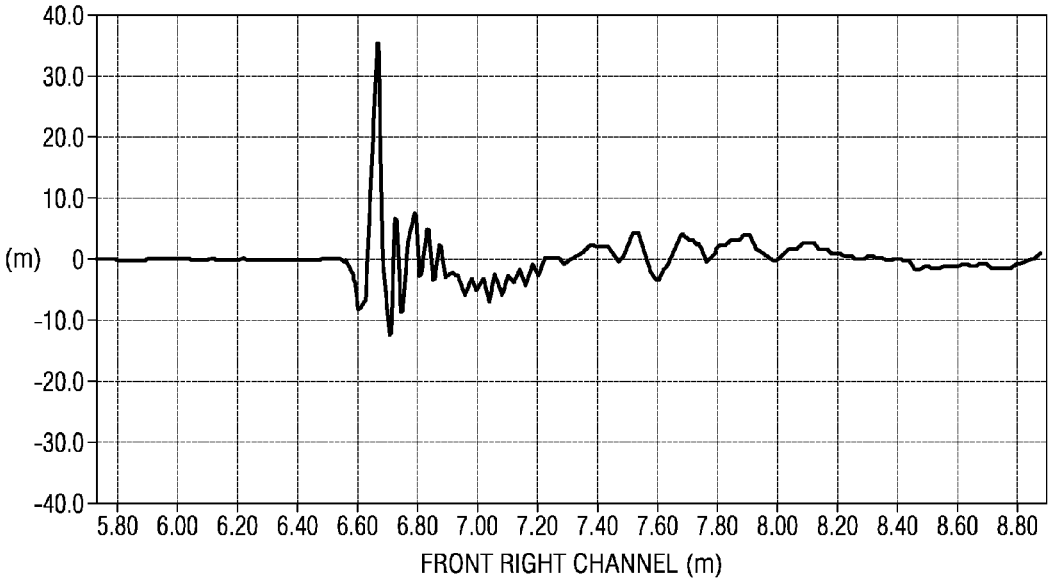

For example, FIG. 3 shows an embodiment of an impulse response of the same two three-way loudspeakers. The loudspeakers of FIG. 3 are both positively connected and placed at the front left and the front right positions, respectively. The impulse response of the front right channel clearly shows that it is wired correctly with the positive connection. However, the polarity is unclear for the front left channel. In fact, one might even conclude that the front left has the negative polarity due to the sharp and large negative impulse.

The difficulty of detecting the polarity for multi-way loudspeakers originates in the fact that they are composed of multiple drivers such as a tweeter, midrange, and woofer. The impulse response measured by the microphone is the superposition of the responses of those different drivers at the microphone position. However, the way of superposition varies depending on the microphone position. This is because the drivers are placed apart in the three dimensional space, and thus the relative distance to them from the microphone can change depending on the microphone position. The impulse response is also affected by the room reflections from the floor, wall, ceiling, and other furniture in the room. On top of that, a loudspeaker designer may deliberately set different polarity for each driver by the cross-over circuit inside the loudspeaker box for some reasons such as to produce a better sound. Therefore, it is not simple to define and detect the loudspeaker polarity from the measured impulse response for the multi-way loudspeakers.

Thus, in one embodiment, the detection of loudspeaker connection polarity is based on their impulse response. As a result, the connection polarity for multi-way loudspeakers is robustly detected. Such an embodiment may also be used for single-way loudspeakers. The proposed method is based on the peak detection of the impulse response. However, the impulse response is modified with band-pass filtering and exponential weighting prior to the peak detection in order to improve the robustness.

This embodiment proposes to detect the polarity of the midrange and woofer drivers as the polarity of multi-way loudspeakers for the following reasons:

1. The frequency range of most of midrange and woofer drivers covers 1 kHz, which is expected to be reproducible by all acoustic loudspeakers even if they have a tiny scale factor and thus are much less efficient. In fact, such frequency is used by standard test tone signals quite often. In this sense, the polarity detection methods, which rely on the frequency range of typical midrange and woofer drivers, are applicable to all kinds of acoustic loudspeakers.
2. The responses of the midrange and woofer drivers are less affected than that of the tweeter by room reflections or by microphone position. Since the tweeter response is largely composed of high frequencies by its nature, it is more oscillatory in a shorter period than that of the midrange and woofer drivers. Thus, when the direct wave response of the tweeter is added with its reflections at the microphone position, those oscillatory waveforms can cancel their signal peaks with each other. Hence, one can deduct that the polarity detection methods that use the tweeter response tend to be more unstable in terms of the influence of the microphone position and the room reflections, as shown in FIG. 3. In FIG. 3, the sharp or high frequency peaks appear in a very different way in the front left and in the front right channels, while greater similarity can be recognized in the low frequency part of the two impulse responses.
3. The extraction of the midrange and woofer responses eliminates the interference with the tweeter response. The interference between the midrange and woofer responses and the tweeter response is sensitive to the microphone position because it originates in the spatial separation of those drivers. On the other hand, since the midrange and woofer responses are composed of low frequencies, they are less affected by the microphone position. Namely, the wavelength is typically longer than the separation of the midrange and the woofer drivers. These facts give another reason for the polarity detection methods being unstable if they rely on the tweeter response.

Therefore, a band-pass filter (BPF) is applied to the measured impulse response in order to extract low frequencies that correspond to the midrange and the woofer drivers. The higher corner frequency of the band-pass filter is set to the typical cross-over frequency between the midrange and the tweeter.

On the other hand, the lower corner frequency of the band-pass filter is determined with respect to the background noise. The background noise usually has pink-noise characteristics, i.e., it has more energy in the low frequency region and less energy in the high frequency region. Hence, it is desirable to filter off the low frequency part of the measured impulse response to reduce the noise component. Otherwise, the low frequency errors will lead to a DC offset error, which disturbs the peak detection.

Figure 4A:
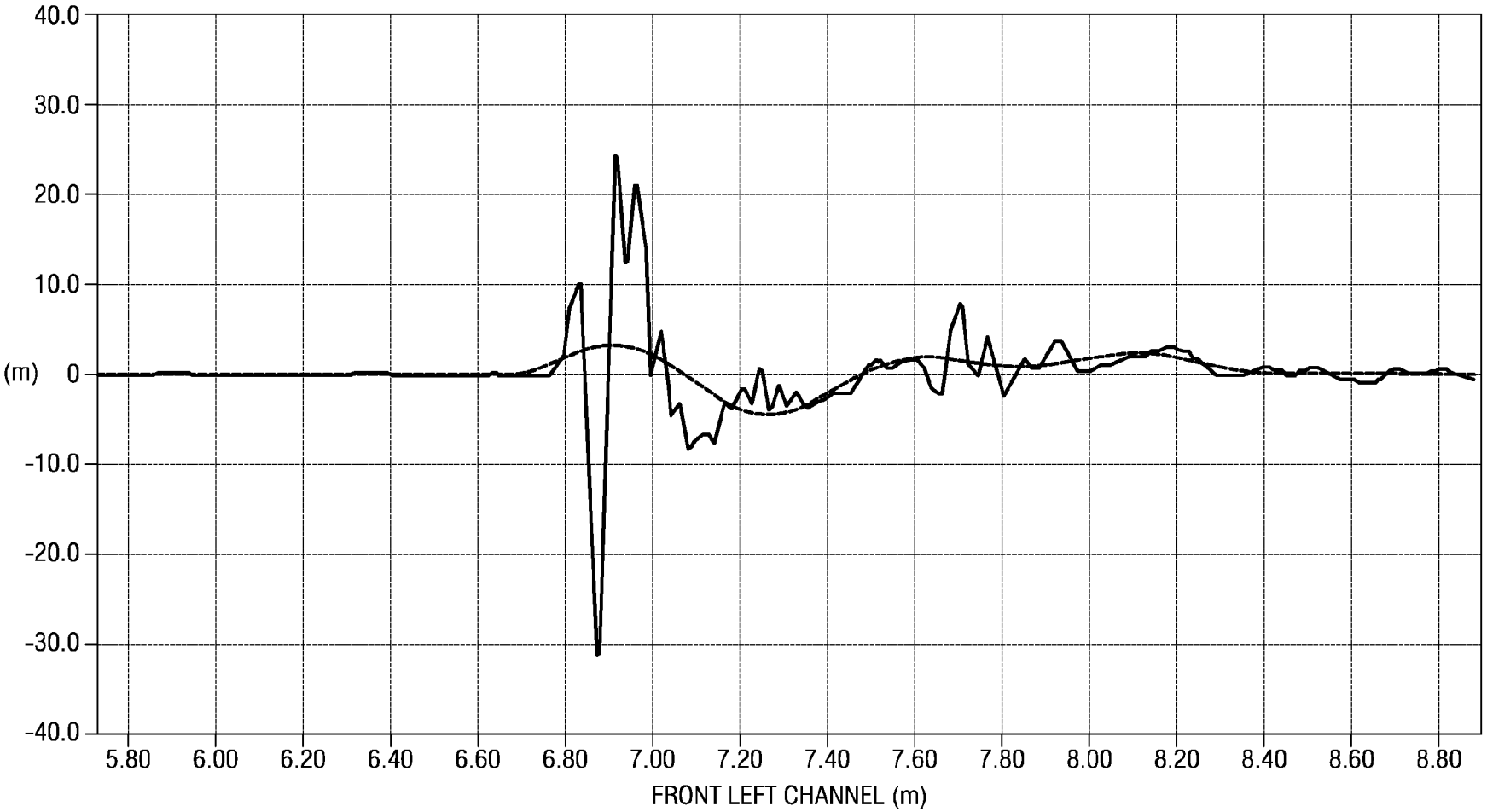
FIG. 4 is an embodiment of a band-pass filter impulse response.
Figure 4B:
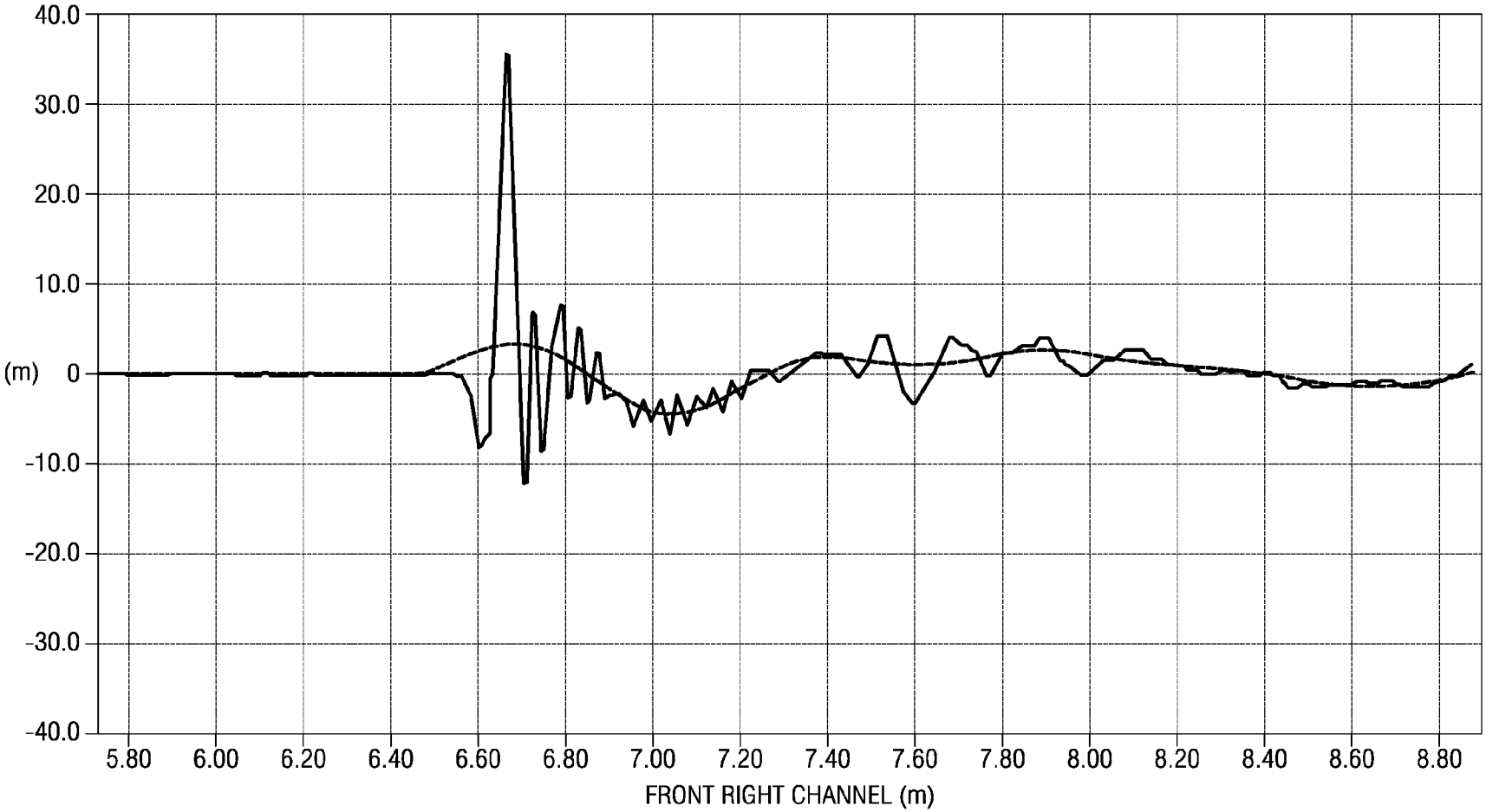

Applying the band-pass filter to the impulse responses of FIG. 3 is shown in FIG. 4. FIG. 4 is an embodiment of a band-pass filter impulse response. In FIG. 4, the lower and the higher corner frequency of the band-pass filter is 50 Hz and 2 kHz, respectively. By eliminating the tweeter response that is sensitive to the microphone position and the room reflections, it can be seen that the polarity now can robustly be detected as the polarity of the first peak of the band-pass filtered impulse response. However, there can be seen several peaks of competing magnitude in the waveforms. In fact, the maximum peak does not always correspond to the first peak.

The present invention proposes to apply exponential weighting to the band-pass filtered impulse response to enable the first peak being found as the maximum peak. The decay rate of the exponential weighting is related to the higher corner frequency of the band-pass filter. This is because the duration between the neighboring peaks in the band-pass filtered impulse response is roughly limited by the higher corner frequency. The duration may not be much shorter than 1/(2 fH), where fH is the higher corner frequency of the band-pass filter. In fact, it can be confirmed that the duration between peaks is close to 1/(2 fH)=0.25 ms in FIG. 4.

Figure 5A:
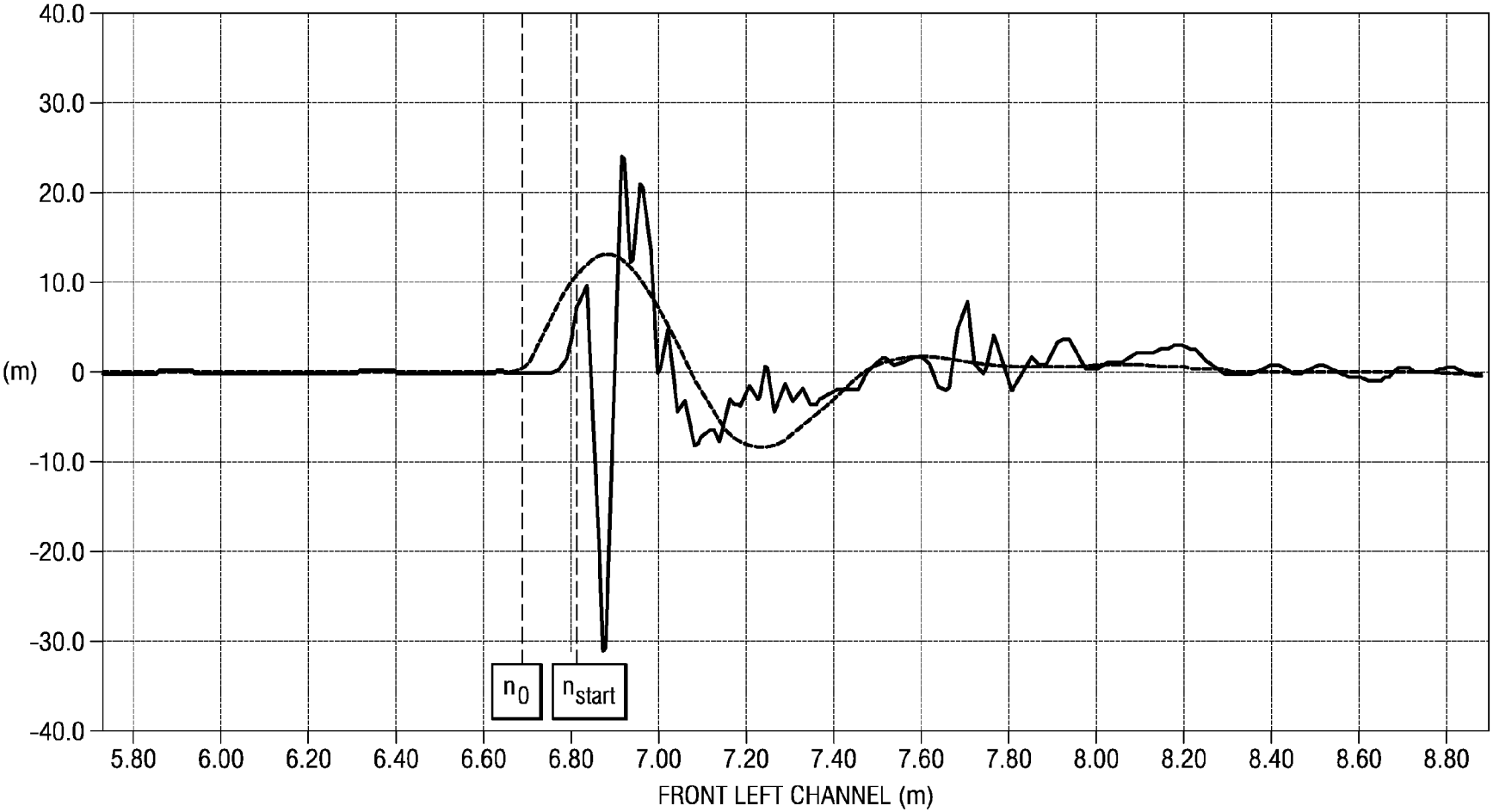
FIG. 5 is an embodiment depicting exponential decay of weight applied to band-pass filtered impulse response.
Figure 5B:
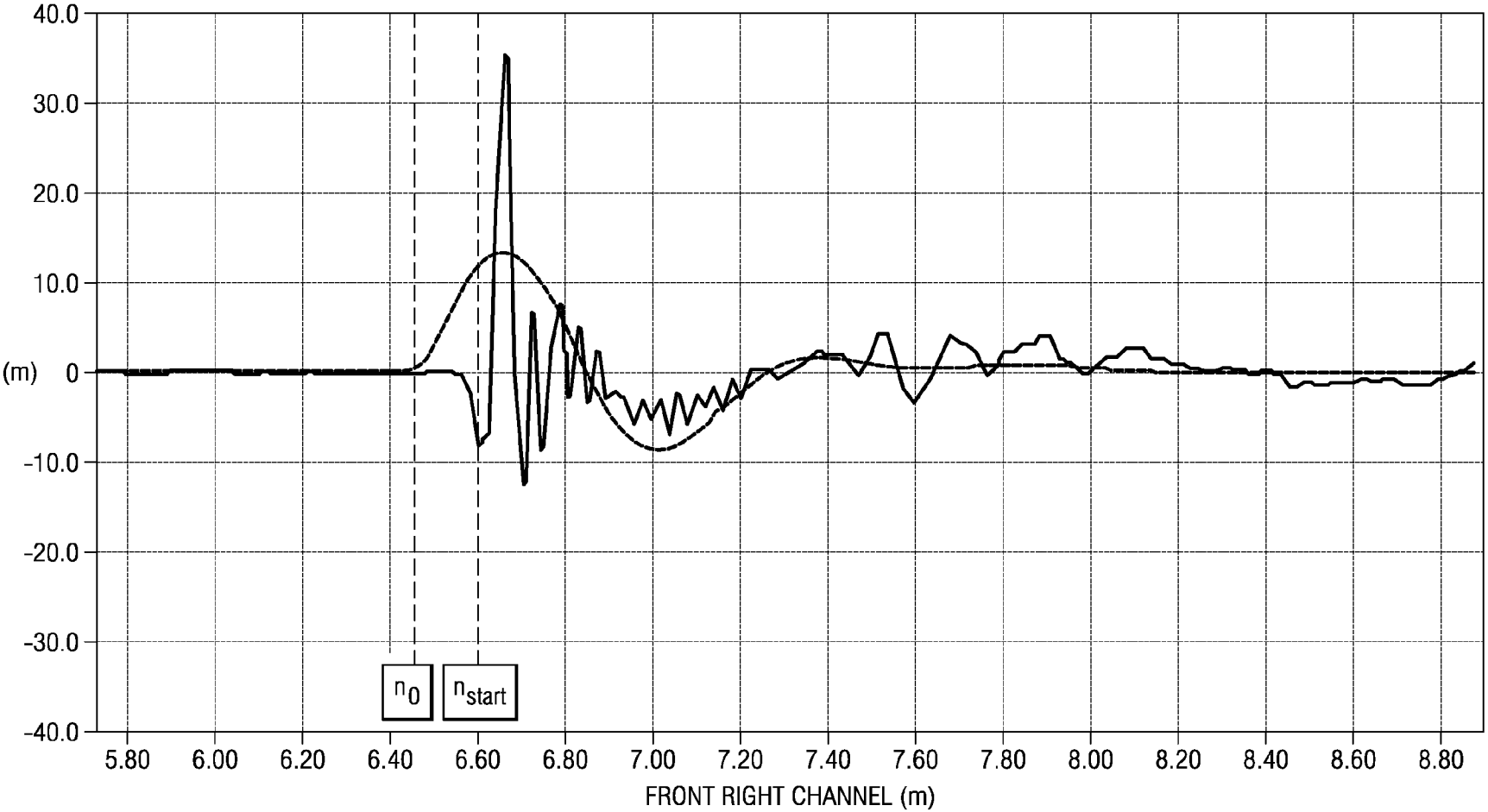

FIG. 5 is an embodiment depicting exponential decay of weight applied to band-pass filtered impulse response. In FIG. 5, the results of the application of the exponentially decaying weight to the waveforms in FIG. 4. The weight application begins with the last zero-crossing point prior to the starting point of the impulse response, which was detected by some other means, such as a threshold. It can be seen that the first peak can now be simply found as the maximum peak in the waveform. Finally, it can be concluded that the connection polarity is positive for both channels because the maximum peaks lie on the positive side.

Let h(n), n=0, 1, . . . , N−1, be the measured impulse response of the loudspeaker of interest sampled at the sample rate $f_s$. Then, we first extract the midrange and woofer component by applying a band-pass filter to h(n). The band-pass filter to be used is desired to have a linear-phase characteristic in order to preserve the phase information of h(n). With a non-linear-phase band-pass filter, the phase information of the extracted waveform will be distorted, and thereby, in the time domain, its peak location and peak magnitude will be changed. However, this is very critical because the proposed method relies on the peak locations and the peak values of the extracted waveform.

In the embodiment shown here, a band-pass filter implemented with discrete Fourier transform (DFT) is used. Let H(k) be the DFT of the impulse response h(n) as $$H(k) = \sum_{n=0}^{N-1} h(n)W^{-nk},\ W = e^{j2\pi/N}.$$

Figure 6:
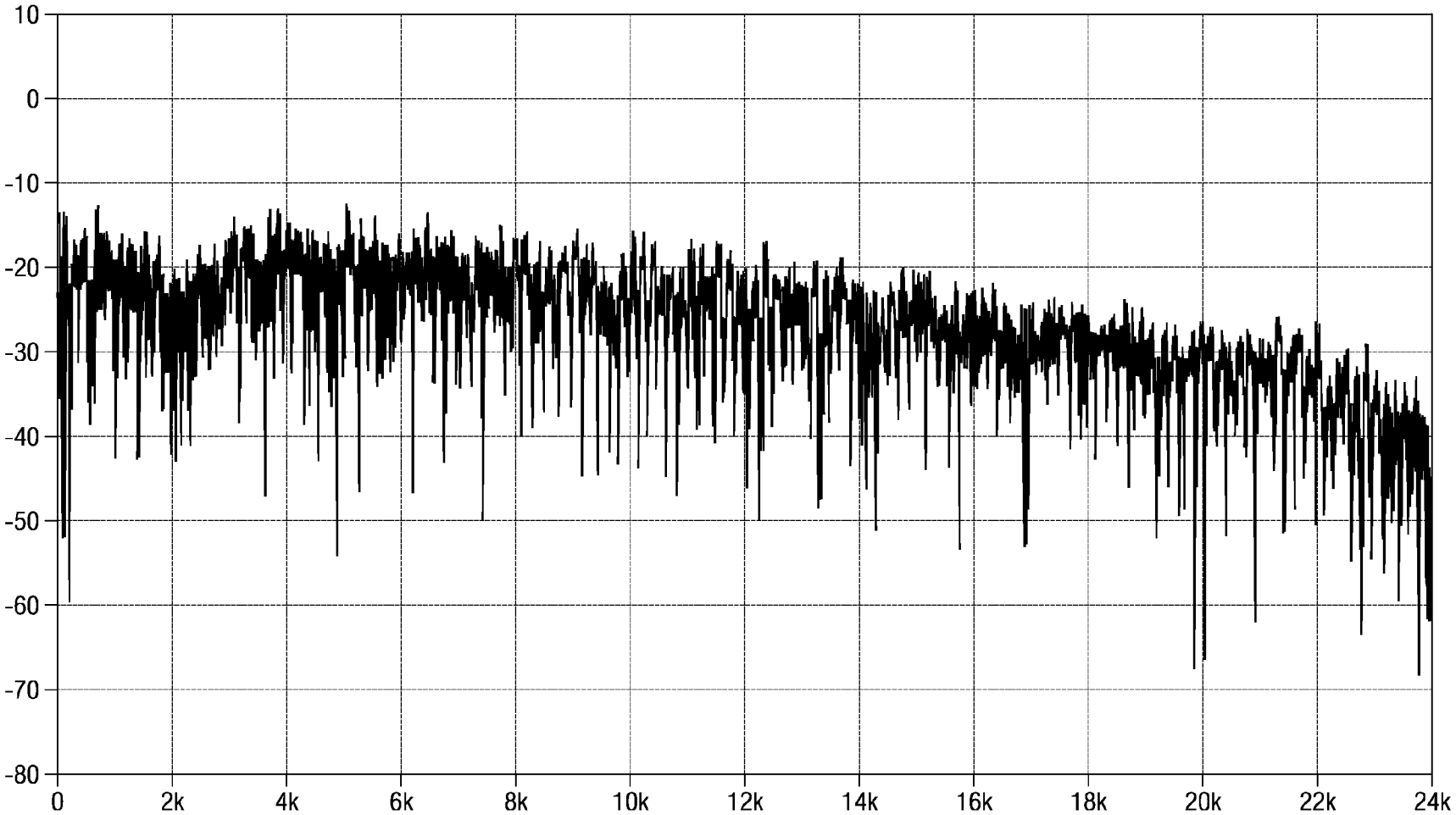
FIG. 6 is an embodiment depicting a frequency response H(k) for the front left channel.
Figure 7:
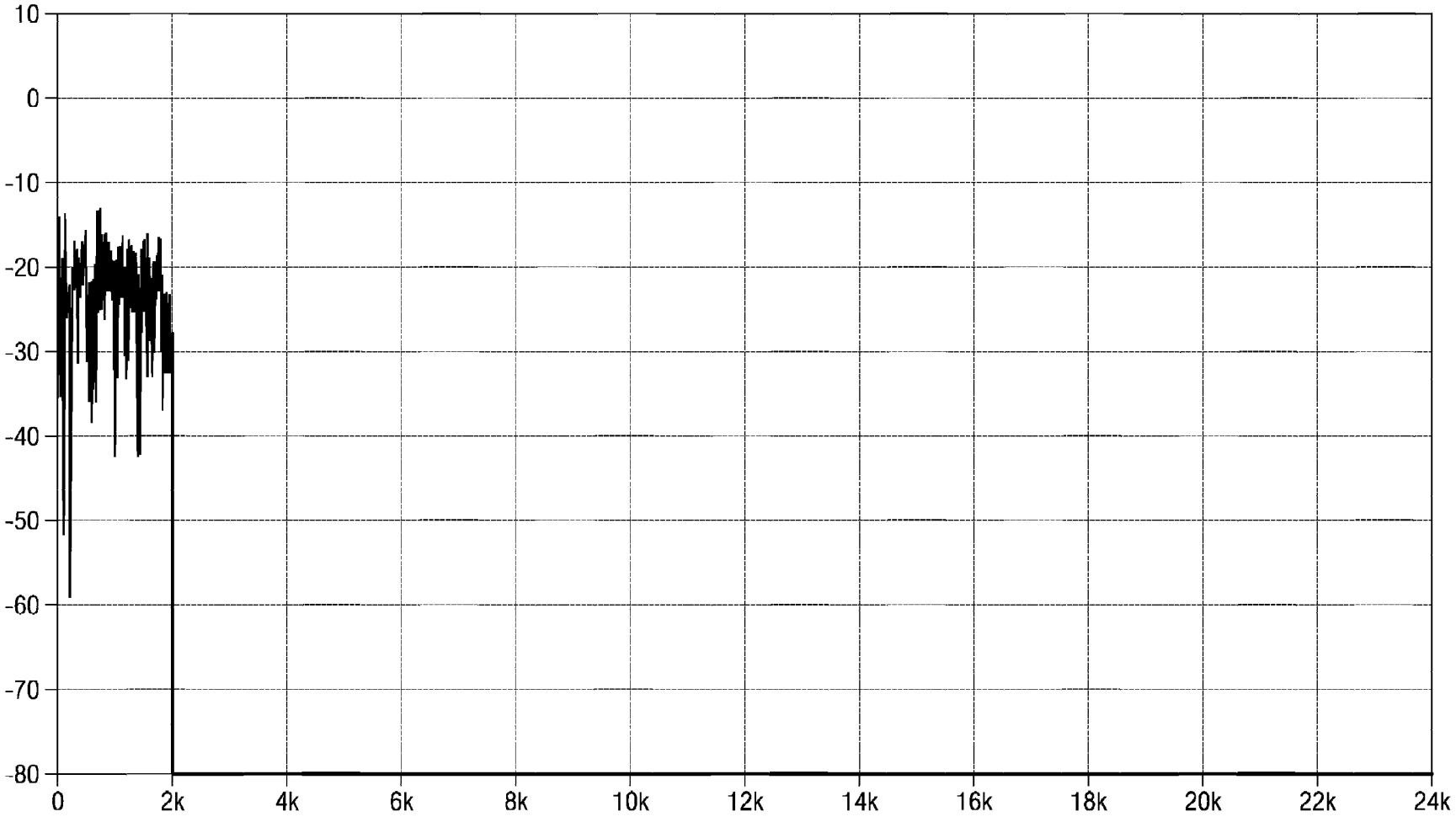
FIG. 7 is an embodiment depicting a band-pass filtered frequency response H(k) for a front left channel ($f_L$=50 Hz and $f_H$=25 Hz).

Then, to extract the frequency components that correspond to the midrange and woofer drivers, the band-pass filter is applied in the frequency domain as $$H_{BPF}(k) = \begin{cases} 0 & \left(|k| < K_L,\ K_H < |k| \le \frac{N}{2}\right) \\ H(k) & (K_L \le |k| \le K_H), \end{cases}$$

$$K_L = \frac{f_L}{f_s}N,\ K_H = \frac{f_H}{f_s}N,$$

where $f_L$ and $f_H$ are the lower and higher corner frequencies of the band-pass filter, respectively, and $K_L$ and $K_H$ are the frequency bin indices corresponding to $f_L$ and $f_H$, respectively. FIG. 6 and FIG. 7 show the example of H(k) and $H_{BPF}(k)$ for the front left channel of FIG. 3, where $f_s$=48 kHz, $f_L$=50 Hz, $f_H$=2 kHz, N=32,768. By taking the inverse DFT, we can obtain the impulse response corresponding to the midrange and woofer drivers as $$h_{BPF}(n) = \frac{1}{N}\sum_{k=-N/2}^{N/2-1} H_{BPF}(k)W^{kn}.$$

As shown in FIG. 4, the waveform $h_{BPF}(n)$ can be oscillatory with peaks of nearly equal magnitude. To help distinguish the first peak from the subsequent peaks, the exponentially decaying weight is applied as $$g(n) = e^{-an}h_{BPF}(n),$$

$$a = \frac{f_H}{f_s}.$$

Note that the decay rate, a, is related to the higher corner frequency $f_H$. This is because the duration between the neighboring peaks is roughly given by $1/(2\ f_H)$, and we want to give a consistent decay to the peaks regardless of the value of $f_H$. In this case, the applied decay from one peak to the next one is $e^{-1/2}$~0.6.

Let $n_{start}$ be the time index of the starting point of the impulse response, which was detected by some other means, such as, a threshold. Then, we first find the last zero-crossing point, $n_0$, in the band-pass filtered impulse response, which is usually prior to the starting point $n_{start}$ (see FIG. 5). Namely, the time index $n_0$ is the largest time index which satisfies $$h_{BPF}(n)h_{BPF}(n+1)<0,\ n<n_{start}$$

Then, we find the time index $n_{peak}$, where the $g(n_{peak})$ has its peak value after the time index $n_0$.

$$n_{peak} = \underset{n_0<n}{\operatorname{argmax}}|g(n)|$$

Finally, the polarity is determined as the sign of $g(n_{peak})$.

$$\text{polarity} = \operatorname{sgn} g(n_{peak}) = \begin{cases} +1 & (g(n_{peak}) > 0) \\ -1 & (g(n_{peak}) < 0) \end{cases}$$

While the foregoing is directed to embodiments of the present invention, other and further embodiments of the invention may be devised without departing from the basic scope thereof, and the scope thereof is determined by the claims that follow.

What is claimed is:

1. A polarity detection method utilized is an apparatus for polarity detection of a loudspeaker connection, the method comprising:

applying a band-pass filter to an impulse response of a loudspeaker;

applying an exponential weighting to the band-pass filtered impulse response, wherein the exponential decay parameter is related to the higher corner frequency of the band-pass filter;

finding the maximum peak in a waveform of sampled impulse responses; and detecting the connection polarity of the maximum peak as the polarity of the peak, wherein the band-pass filtering and exponential weighting to the band-pass filtered impulse response are performed prior to the maximum peak detection.

2. The polarity detection method of claim 1, wherein the loudspeaker is at least one of a single or a group of multi-way loudspeaker.

3. A polarity detection apparatus, comprising:

means for applying a band-pass filter to an impulse response of a loudspeaker;

means for applying an exponential weighting to the band-pass filtered impulse response, wherein the exponential decay parameter is related to the higher corner frequency of the band-pass filter;

means for finding the maximum peak in a waveform of sampled impulse responses; and means for detecting the connection polarity with the maximum peak as the polarity of the peak, wherein the means for detecting the connection polarity with the maximum peak is utilizing after the band-pass filtering and exponential weighting to the band-pass filtered impulse response are performed.

4. The polarity detection apparatus of claim 3, wherein the loudspeaker is at least one of a single or a group of multi-way loudspeaker.

5. A non-transitory computer readable medium comprising software that, when executed by a processor, causes the processor to perform a polarity detection method for polarity detection of a loudspeaker, the polarity detection method comprising:

applying a band-pass filter to an impulse response of a loudspeaker;

applying an exponential weighting to the band-pass filtered impulse response, wherein the exponential decay parameter is related to the higher corner frequency of the band-pass filter;

finding the maximum peak in a waveform of sampled impulse responses; and detecting the connection polarity of the maximum peak as the polarity of the peak, wherein the band-pass filtering and exponential weighting to the band-pass filtered impulse response are performed prior to the maximum peak detection.

6. The computer readable medium of claim 5, wherein the loudspeaker is at least one of a single or a group of multi-way loudspeaker.

* * * * *